United States Patent [19]

McGraw

[11] Patent Number: 4,622,017

[45] Date of Patent: Nov. 11, 1986

[54] OAR WITH PIVOTAL BLADES

[76] Inventor: Gilles McGraw, 4236 Delanaudiere, Montreal, Quebec, Canada, H2J 3N9

[21] Appl. No.: 614,739

[22] Filed: May 25, 1984

[30] Foreign Application Priority Data

May 25, 1983 [CA] Canada ..... 428890

[51] Int. Cl.[4] ..... B63H 16/04

[52] U.S. Cl. ..... 440/101; 416/74

[58] Field of Search ..... 440/13–15, 440/17, 19, 20, 21, 101, 102, 105; 416/69, 70 R, 72, 73, 74; D12/215

[56] References Cited

U.S. PATENT DOCUMENTS 427,842 5/1890 Dice et al. ..... 440/19
1,066,662 7/1913 Schmidt, Jr. ..... 416/74
1,555,097 9/1925 Beebe ..... 416/74
1,805,749 5/1931 Zoglauer ..... 416/74
3,135,977 6/1964 Vidal ..... 416/74

*Primary Examiner*—Trygve M. Blix
*Assistant Examiner*—Jesûs D. Sotelo
*Attorney, Agent, or Firm*—Joseph G. Seeber

[57] ABSTRACT

An oar or paddle comprising a shaft having two parallel grooves of circular cross-section extending throughout its length, each groove pivotally supporting a blade. The grooves have a peripheral extent which permits the blades to pivot between a position in which they are parallel and a further position in which they project in opposite directions in a common plane. The blades are located axially of the grooves by retainers which are mounted in the grooves at opposite ends of the portion of the blades disposed within the groove.

16 Claims, 6 Drawing Figures

OAR WITH PIVOTAL BLADES

DESCRIPTION

1. Field of the Invention

This invention related to oars, paddles and the like which are used to propel rowing boats, canoes, dingies and the like over water.

2. Background Art

Oars, paddles and the like usually comprise a shaft having an integral blade at one end thereof which, when the oar is moved through water, with the blade disposed at right angles to the direction of movement of the oar, causes a reaction which propels the boat.

At the end of each such stroke or movement of the oar or paddle, it is lifted out of the water, returned to its initial position and the propelling stroke repeated.

It would be desirable, and would reduce the energy used by an operator, if the oar or paddle blade could remain immersed in the water during the return stroke, but with oars or paddles constructed as described above, this would not be possible because of the resistance of the water on the integral blades.

It has previously been proposed in Canadian Pat. No. 262860 (Beebe) to construct an oar in which the blades are pivotally mounted on a frame attached to a shaft, the frame member being constructed such that when the blades are moved to a position at right angles to the direction of movement of the oar by the resistance of the water, they are retained in the divergent position. In addition the frame includes stop means positioned so that during the return stroke of the oar with the blades still in the water, the blades will be moved into engagement with the stop by the resistance of the water so as to lie parallel with each other.

DISCLOSURE OF THE INVENTION

It is an object of the present invention to provide an improved construction of oar or paddle having pivotal blades, in which the means for pivotally supporting the blades and for limiting the pivotal movement are formed integrally with the shaft.

It is a further object of the invention to provide an oar or paddle which can be readily dismantled from transport, storage and repair.

BRIEF DESCRIPTION OF THE DRAWINGS

In order that the invention can be understood and readily carried into effect and so that the above objects will become apparent, an oar in accordance with the invention will now be described, by way of example only, with reference to the accompanying drawings, in which.

DESCRIPTION OF A PREFERRED EMBODIMENT

Figure 1:
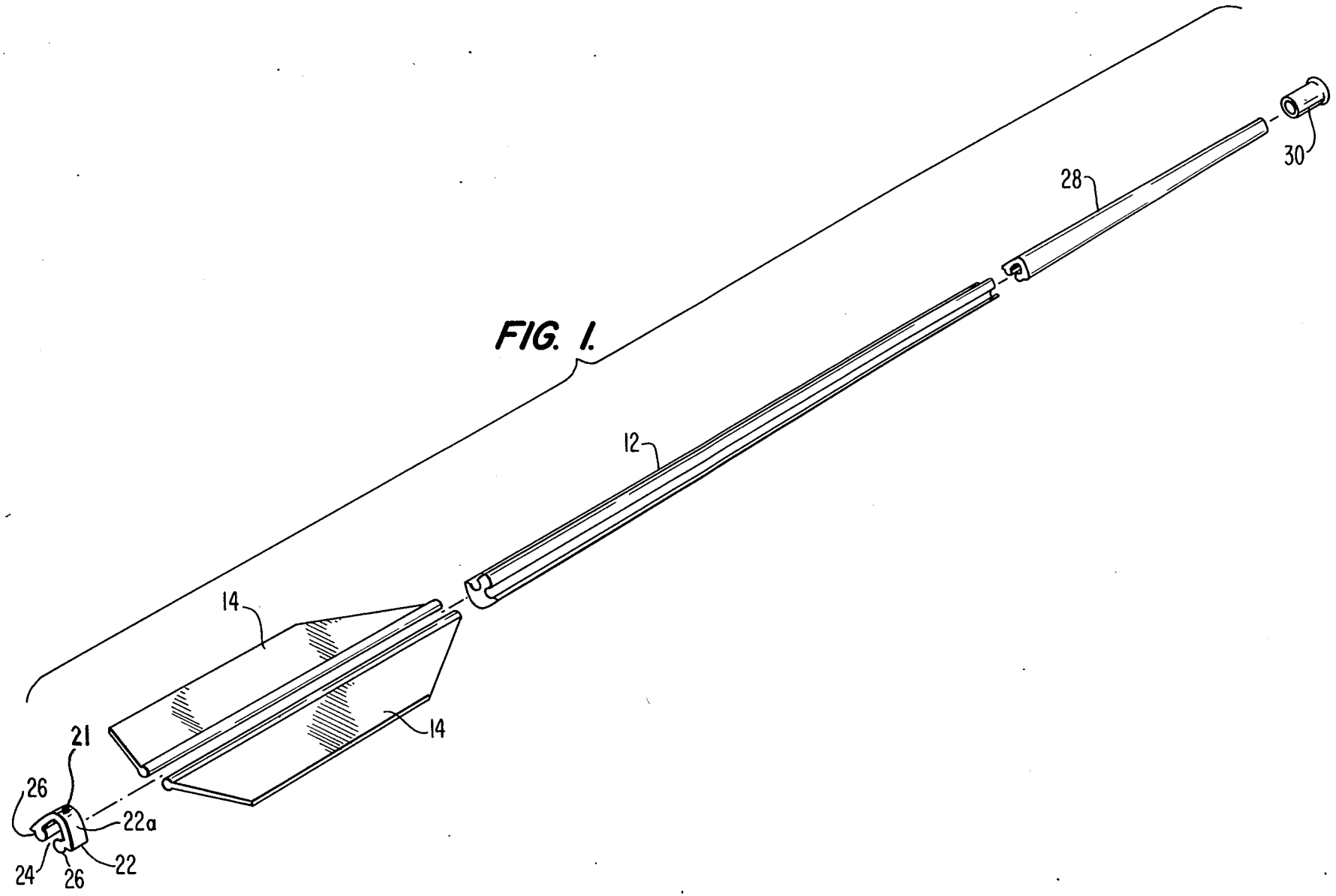
FIG. 1 is a perspective, exploded view of an oar in accordance with the invention.
Figure 2:
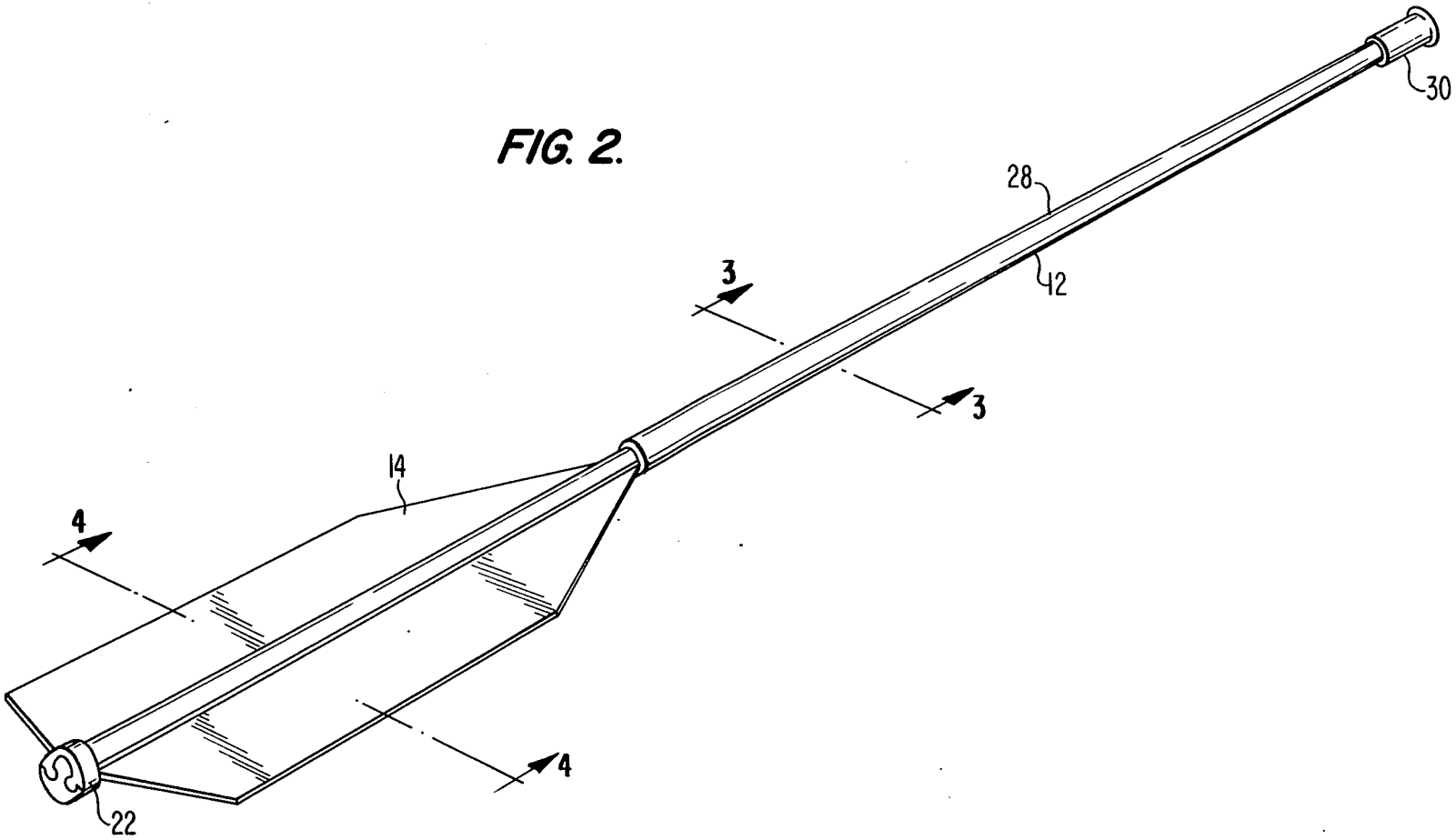
FIG. 2 is a perspective view showing the parts illustrated in FIG. 1 assembled together.
Figure 3:
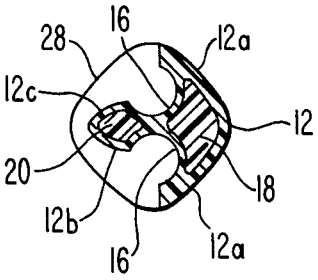
FIG. 3 is a sectional view on line III—III in FIG. 2.
Figure 4:
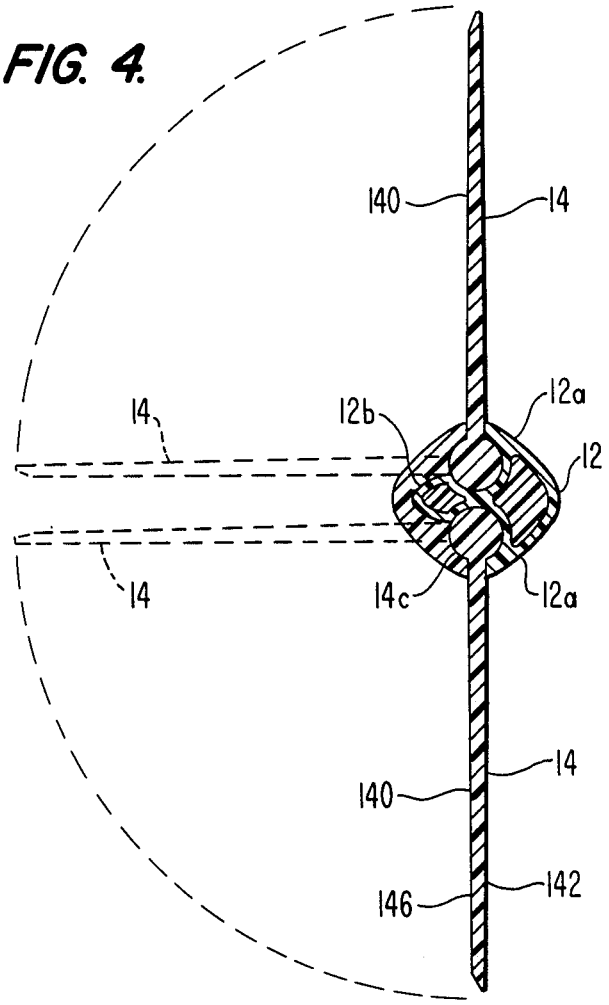
FIG. 4 is a sectional view on line IV—IV in FIG. 2.

Referring to FIGS. 1 to 5 of the drawings, 10 indicates an oar comprising a shaft 12 and blades 14 mounted on one end thereof for pivotal movement between a position in which they project laterally of the shaft 12 in opposite directions, as shown in full lines in FIG. 4 of the drawings, and a position in which they project in the same direction, as shown in broken lines in FIG. 4, and are disposed substantially parallel with each other.

The shaft 12 is substantially "T" shaped in cross-section, as shown in FIGS. 3 and 4 of the drawings, the upper surface of the cross-member the "T" being defined by two convex surfaces 12*a* which extend upwardly and inwardly towards each other and merge to form a continuous surface. The leg 12*b* of the "T" is provided with an enlarged end 12*c*, and a circular groove 16 is formed in the shaft 12 on each side of the leg 12*b* and extends through the full length of the shaft 12. As can be seen from FIG. 3 of the drawings, the periphery of each groove subtends an arc which is greater than 180°, for the purpose which will hereinafter be described. The cross-member of the shaft 12 and the enlarged portion 12*c* are of hollow construction, to provide chambers 18 and 20 respectively which may be filled with multicellular plastic material to ensure buoyancy of the oar.

Each blade 14 comprises an elongated plate-like member 140, one longitudinal edge 142 being of greater length than the other longitudinal edge 146, and defines a circular pivot member 14*c* whose diameter is such that it will be slidable into and rotable within the groove 16.

A blade 14 is mounted in each groove 16 by inserting the pivot member 14*c* of the blade into the groove 16 from one end of its shaft 12 and moving the blade 14 along the length of the shaft 12 until the pivot member 14 is completely disposed within the groove.

A retainer 22, having a slot 24 which corresponds in shape to the shape of the leg 12*b* and projections 26 which engage in the grooves 16 is mounted on the end of the shaft 12 and retained in position by means of a screw 21. The outer surface 22*a* of the retainer is a mirror image of the shape of the upper surface of the cross-member of the shaft 12.

A second retainer 28 of the same cross-sectional shape as the retainer 22, is also mounted on the shaft 12, but is inserted from the end opposite to that on which the retainer 22 is mounted. The length of the second retainer 28 is such that when it is mounted on the shaft, the distance between its inner end and the inner end of the retainer 22 will permit the blades to pivot but will prevent axial movements thereof. A handle 30 is mounted on the shaft 12 to prevent movement of the retainer axially of the shaft, whereby the blades 14 are retained in the shaft.

When the above described oar is in use and with the user facing opposite to the direction in which the boat is to travel, the oar which is mounted in a rowlock, is dipped into the water to immerse, the blades 14, with the shaft disposed so that the leg 12*b* is pointed in the direction opposite to that in which the boat is to travel; the oar is then pulled towards the user to perform a power stroke whereby it pivots about the rowlock and the blades move rearwardly of the boat, during which movement the reaction of the water on the blades moves them to the full line position shown in FIG. 4 of the drawings, and the boat is propelled through the water. The oar is then pushed away from the user without removing the blades from the water and during this movement the resistance of the water turns the blades to the broken line position shown in FIG. 4 of the drawings in which they are disposed susbtantially parallel to each other.

It will be seen therefore that because the oar can be returned to the starting position for a subsequent power stroke without removing the blades from the water, less energy is used to propel the boat.

Figure 5:
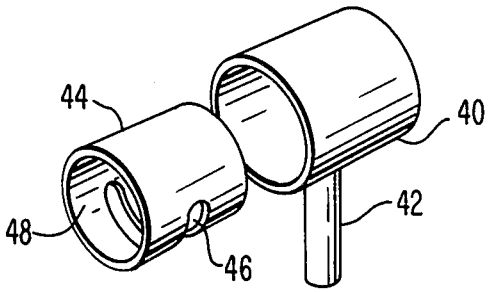
FIG. 5 is an exploded view of a row lock for use with the oar shown in the drawings.
Figure 6:
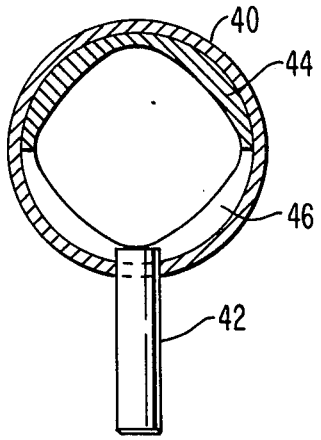
FIG. 6 is a view showing the parts illustrated in FIG. 5 assembled together.

A further feature of the invention resides in the provision of an oarlock or rowlock for use with an oar in accordance with the invention. Referring to FIGS. 5 and 6 of the drawings, the oarlock comprises an outer sleeve 40 which includes a pivot pin 42, of circular cross-section, the inner end of which projects into the bore of the sleeve 40. An inner sleeve 44 is mounted within the outer sleeve 40, and includes a slot 46 into which the inner end of the pivot pin 42 projects as shown in FIG. 6 of the drawings. Thus the inner sleeve 44 can be rotated relative to the outer sleeve 40 but is prevented from moving axially relative thereto.

The bore 48 of the inner sleeve 44 has the same cross-sectional shape as that defined when the second retainer 28 is mounted on the shaft 12, as shown in FIG. 3 of the drawings, whereby it fits snugly thereover.

Whilst in the above example the invention has been described in relation to an oar, it is also applicable to a canoe paddle having a blade at one end.

The retainer preferably comprises a buoyant material, and together with the shaft and blades may be produced by an extrusion process and then cut into suitable lengths from which an oar or paddle may be assembled.

However, the aforementioned components may be fabricated in any other suitable manner.

The embodiments of the invention in which an exclusive property or privilege is claimed are defined as follows:

1. A device for propelling a vessel through water, said device comprising a shaft having two parallel grooves of circular cross-section, each groove pivotally supporting a blade and having a peripheral extent which permits the blades to pivot between a position in which the blades are parallel and a further position in which the blades project in opposite directions in a common plane, wherein the shift is substantially "T" shaped in cross-section, the grooves being formed on each side of a leg of the "T", said device including means for locating and retaining the blades, said means for locating and retaining the blades comprising members adapted to engage over the leg of the "T" and having an external profile which is the same as an external profile of a cross-member of the "T".

2. The device as claimed in claim 1, wherein the grooves extend throughout the length of the shaft, said means for locating and retaining the blades being provided to locate and retain the blades axially relative to the shaft.

3. The device as claimed in any one of claims 1 or 2, wherein the shaft is provided with at least one cavity containing a buoyant material.

4. The device as claimed in any one of claims 1 or 2, wherein each blade comprises a rectangular member having a pivot member formed on one longitudinal edge for engagement in the groove.

5. The device as claimed in claim 1, wherein the means for locating and retaining the blades comprises a buoyant material.

6. A device for propelling a vessel through water, said device comprising a shaft having two parallel grooves of circular cross-section extending throughout the length of the shaft, each groove pivotally supporting a blade and having a peripheral extent which permits the blades to pivot between a position in which they are parallel and a further position in which they project in opposite directions in a common plane, said device including means for locating and retaining the blades axially relative the the shaft.

7. The device as claimed in claim 6, wherein the shat is substantially "T" shaped in cross-section, the grooves being formed on each side of a leg of the "T".

8. The device as claimed in any one of claims 6 or 7, wherein the shaft is provided with at least one cavity containing a buoyant material.

9. The device as claimed any one of claims 6 or 7, wherein each blade comprises a rectangular member having a pivot member formed on one longitudinal edge for engagement in the groove.

10. The device as claimed in claim 7, wherein the means for locating and retaining the blades comprises members adapted to engage over the leg of the "T" and having an external profile which is the same as an external profile of a cross-member of the "T".

11. The device as claimed in claim 10, wherein the means for locating and retaining the blades comprises a buoyant material.

12. The device as claimed in claim 6, wherein the means for locating and retaining the blades engages the two parallel grooves at all points along the length of the shaft not occupied by the blades.

13. A device for propelling a vessel through water, said device comprising a shaft having two parallel grooves of circular cross-section, each groove pivotally supporting a blade, wherein said shaft is substantially "T" shaped in cross-section, the grooves being formed on each side of a leg of the "T" and having a peripheral extent which permits the blades to pivot between a position in which they are parallel and a further position in which they project in opposite directions in a common plane, said device comprising means for locating and retaining the blades, wherein the means for locating and retaining the blades comprises members adapted to engage over the leg of the "T" and having an external profile which is the same as an external profile of a cross-member of the "T".

14. The device as claimed in claim 13, wherein the means for locating and retaining the blades comprises a buoyant material.

15. A device for propelling a vessel through water, said device comprising a shaft having two parallel grooves of circular cross-section, each groove pivotally supporting a blade, wherein said shaft is substantially "T" shaped in cross-section, the grooves being formed on each side of a leg of the "T" and having a peripheral extent which permits the blades to pivot between a position in which they are parallel and a further position in which they project in opposite directions in a common plane, said device comprising means for locating and retaining the blades, wherein the means for locating and retaining the blades engages the two parallel grooves at all points along the length of the shaft not occupied by the blades,

16. The device as claimed in claim 15, wherein the means for locating and retaining the blades comprises a buoyant material.

* * * * *

UNITED STATES PATENT AND TRADEMARK OFFICE

CERTIFICATE OF CORRECTION

PATENT NO. : 4,622,017

DATED : November 11, 1986

INVENTOR(S) : Gilles McGraw

It is certified that error appears in the above—identified patent and that said Letters Patent is hereby corrected as shown below:

Column 3, line 43, "shift" should read "shaft".

Column 4, line 9, "shat" should read "shaft".

Signed and Sealed this

Third Day of February, 1987

*Attest:*

DONALD J. QUIGG

*Attesting Officer*

*Commissioner of Patents and Trademarks*